US005174123A

United States Patent [19]

Erickson

[11] Patent Number: 5,174,123

[45] Date of Patent: Dec. 29, 1992

[54] METHODS AND APPARATUS FOR OPERATING A REFRIGERATION SYSTEM

[75] Inventor: Lee J. Erickson, Bloomington, Minn.

[73] Assignee: Thermo King Corporation, Minneapolis, Minn.

[21] Appl. No.: 749,358

[22] Filed: Aug. 23, 1991

[51] Int. Cl.[5] ..... F25B 41/00

[52] U.S. Cl. ..... 62/113; 62/222; 62/513; 62/278; 62/323.1

[58] Field of Search ..... 62/222, 115, 498, 224, 62/278, 201, 323.1, 223, 113, 513, 174

[56] References Cited

U.S. PATENT DOCUMENTS 2,590,061 3/1952 Ash ..... 62/201
4,259,848 4/1981 Voight ..... 62/513
4,773,234 9/1988 Kann ..... 62/513

*Primary Examiner*—John Sollecito
*Attorney, Agent, or Firm*—D. R. Lackey

[57] ABSTRACT

Methods and apparatus for eliminating the need for a float valve in a flash tank of a refrigeration system having an economizer cycle, improving stationary refrigeration systems and permitting a flash tank instead of a heat exchanger to be used in a transport refrigeration system having an economizer cycle. The refrigeration system includes a refrigerant compressor, a condenser, and an evaporator, with the flash tank being disposed between the condenser and evaporator. A liquid sub-cooling valve is disposed between the condenser and flash tank. The liquid sub-cooling valve opens and closes to maintain a desired degree of sub-cooling, with the liquid sub-cooling valve thus controlling refrigerant flow into the flash tank. Refrigerant flow out of the flash tank to the evaporator is controlled by a suction superheat thermostatic expansion valve. In a preferred embodiment, liquid leaving the flash tank is sub-cooled before entering the expansion valve.

18 Claims, 2 Drawing Sheets 10
12
14
16
18
22
23
24
24'
24"
26
28
30
32
34
36
38
40
42
44
45
46
48
50
52
54
56
58
60
62
63
64
66
68
70
72
74
76
78
79
80
81
82
84
D
IP
S
ELECTRICAL CONTROL
TO SOLENOID VALVE 34
HEAT SOURCE 10
26
28
52
54
58
56
30
24'
84
ELECTRICAL CONTROL
TO SOLENOID VALVE 78
16
81
HEAT SOURCE
44
74
22
D
76
78
24
20
14
1P
12
S
68
45
72
64
62
32
66
70
63
60
79
42
38
24"
34
50
36
40
46
80
82
48
23

METHODS AND APPARATUS FOR OPERATING A REFRIGERATION SYSTEM

TECHNICAL FIELD

The invention relates in general to refrigeration systems, and more specifically to refrigeration systems which have an economizer cycle.

BACKGROUND ART

U.S. Pat. No. 4,850,197, which is assigned to the same assignee as the present application, discloses a vapor compression refrigeration system based on an economizer cycle, such as a screw compressor economizer cycle. The refrigeration system of the aforesaid patent utilizes an economizer heat exchanger which is used in conjunction with an intermediate port of the refrigerant compressor. The economizer heat exchanger enhances a refrigerant cooling cycle by cooling the main refrigerant flow from a receiver to an evaporator. The economizer heat exchanger enhances a refrigerant hot gas heating and/or defrost cycle by adding heat to the heat exchanger during a hot gas heating and/or defrost cycle, to cause the heat exchanger to function as an evaporator.

Stationary refrigeration systems which have an economizer cycle use a flash tank instead of an economizer heat exchanger, with the flash tank having certain advantages over the use of a heat exchanger. For example, the economizer heat exchanger requires a refrigerant charge, thus adding to the total refrigerant charge in the system. A heat exchanger also has an efficiency loss due to the heat exchanger temperature difference across the heat exchange interface. The flash tank, in effect, functions as a perfect heat exchanger, as it has no heat exchange interface, thus providing liquid refrigerant with more subcooling to the expansion valve than a heat exchanger.

Because of these advantages, it would be desirable to be able to use a flash tank in a transport refrigeration system, such as transport refrigeration systems used on trucks, trailers, containers, and the like, to control the temperature of a served cargo space. Prior art flash tanks of which I am aware, however, utilize a suction super-heat valve to control the flow of refrigerant from a refrigerant condenser to the flash tank, and they utilize a float valve to control the flow of refrigerant from the flash tank to an evaporator. A float valve works fine in stationary refrigeration systems where a flash tank is used. A float valve, however, does not perform well and is impractical in a transport refrigeration system, because of the constant movement of liquid refrigerant in the flash tank while the transport refrigeration system is moving with its associated vehicle.

SUMMARY OF THE INVENTION

Briefly, the present invention includes methods and apparatus which improve stationary refrigeration systems which utilize an economizer cycle, and the invention makes it possible to use a flash tank in a transport refrigeration system which has an economizer cycle, such as a screw compressor economizer cycle, by eliminating the need for a float valve. The methods and apparatus are applicable to a refrigeration system which includes a refrigerant circuit having a refrigerant compressor which includes a suction port, an intermediate pressure port, and a discharge port. The refrigerant circuit further includes a condenser, an evaporator, a liquid line between the condenser and evaporator, a main suction line between the evaporator and the suction port, an auxiliary suction line between the flash tank and the intermediate pressure port, and a hot gas line between the discharge port and condenser.

The new methods include the steps of providing a flash tank, providing a cooling cycle by directing refrigerant from the compressor and condenser to the evaporator via the flash tank, controlling the flow of refrigerant which enters the flash tank from the condenser with a liquid sub-cooling valve, which opens and closes to maintain a predetermined degree of sub-cooling in the refrigerant, and controlling the flow of refrigerant which flows from the flash tank to the evaporator with a thermostatic expansion valve which has a temperature control bulb disposed in heat exchange relation with the main suction line.

The apparatus includes a flash tank in the liquid line, which eliminates the need for a conventional receiver tank, and a liquid sub-cooling valve disposed between the condenser and the flash tank. The liquid sub-cooling valve controls the flow of refrigerant which enters the flash tank from the condenser by opening and closing to maintain a predetermined degree of sub-cooling in the refrigerant. A thermostatic expansion valve is disposed between the flash tank and the evaporator. The thermostatic expansion valve has a temperature control bulb disposed in heat exchange relation with the main suction line. The suction superheat thermostatic expansion valve controls the flow of refrigerant from the flash tank to the evaporator. Thus, the need for a float valve in the flash tank to control refrigerant flow is eliminated. The elimination of a float valve makes the use of a flash tank practical in a transport refrigeration system, and the invention may also be used to advantage in a stationary system.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
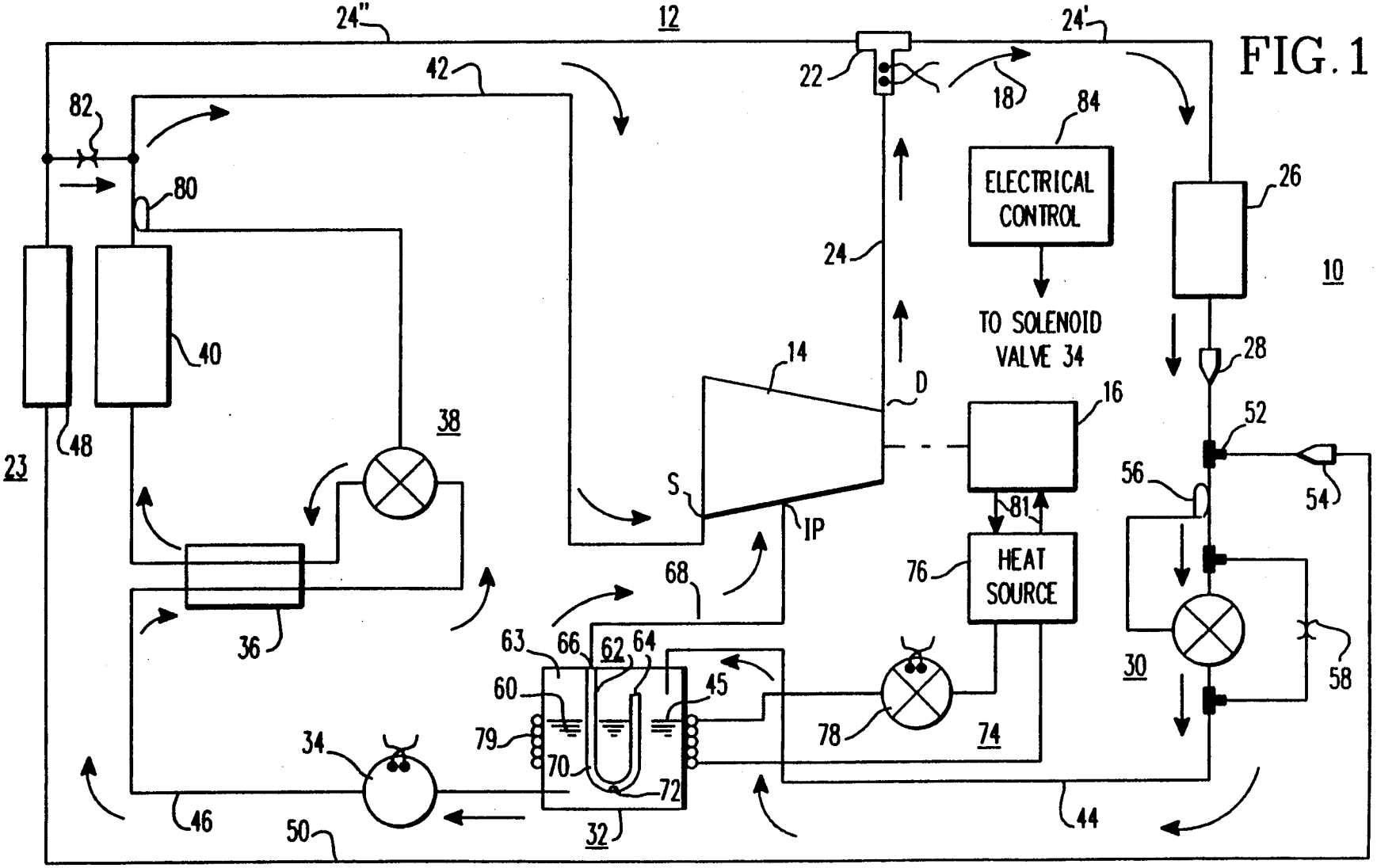
FIG. 1 illustrates a refrigeration system constructed according to the teachings of the invention, with refrigerant valves being shown in positions they assume during a cooling cycle.
Figure 2:
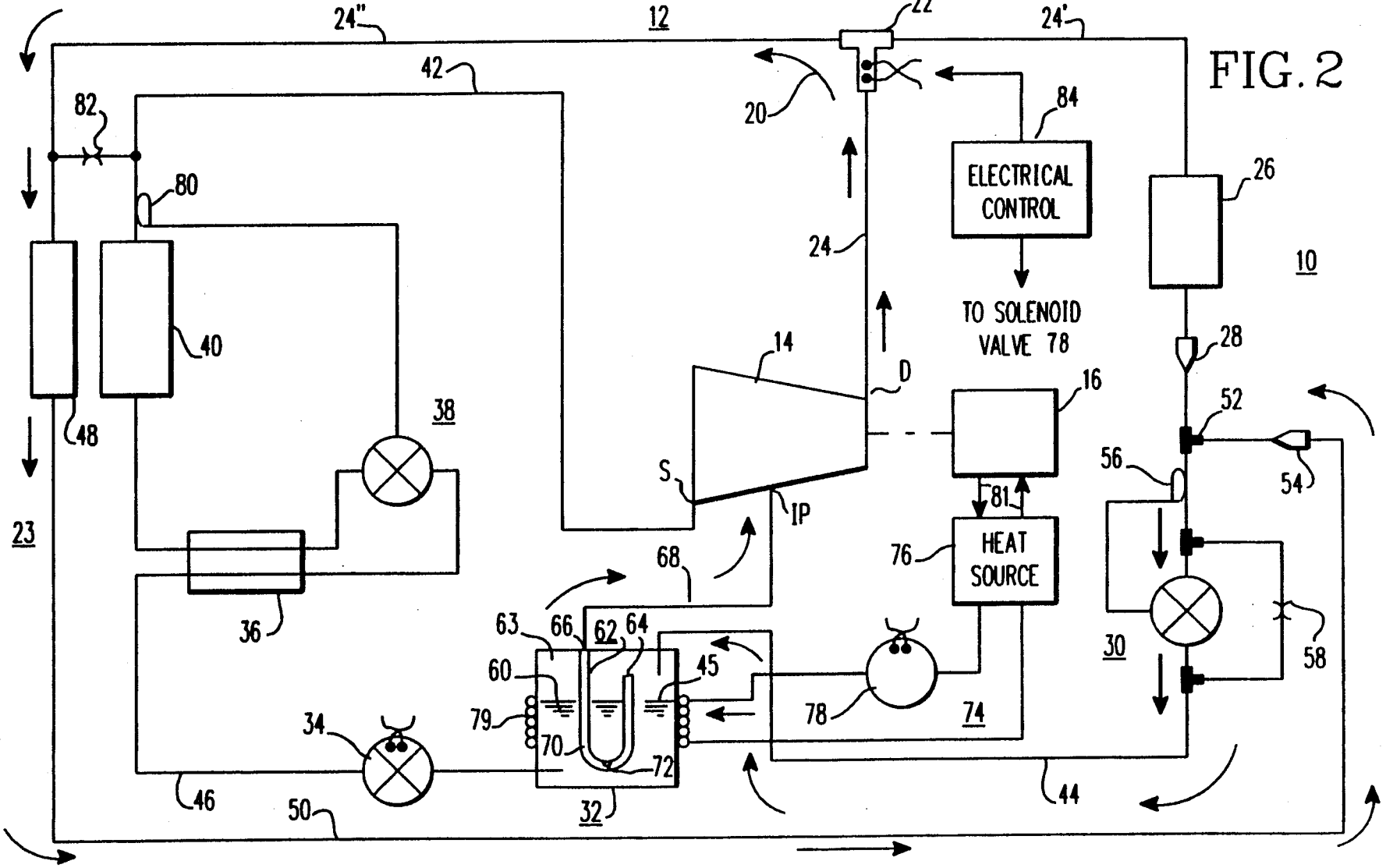
FIG. 2 illustrates the refrigeration system shown in FIG. 1, except with the refrigerant valves being shown in positions they assume during a hot gas heating and/or defrost cycle.

Referring now to the drawings, FIGS. 1 and 2 set forth a piping diagram of a refrigeration system 10 constructed according to the teachings of the invention. FIG. 1 illustrates refrigeration system 10 in a cooling cycle, and FIG. 2 illustrates refrigeration system 10 in a hot gas heating cycle, or a hot gas defrost cycle. U.S. Pat. Nos. 4,182,134 and 4,736,597 illustrate typical construction details of a refrigeration system, and U.S. Pat. Nos. 4,325,224 and 4,419,866 illustrate typical electrical controls for a refrigeration system, all of which are assigned to the same assignee as the present application. Accordingly, only the details of a refrigeration system necessary to understand the invention will be described.

More specifically, refrigeration system 10 shown in FIGS. 1 and 2 includes a refrigerant circuit 12 which includes a compressor 14 of the type having a suction port S, an intermediate pressure port IP, and a discharge port D, such as a screw compressor. Compressor 14 is driven by a prime mover 16, such as an electric motor or an internal combustion engine.

Refrigerant circuit 12 includes first and second selectable paths 18 and 20, controlled by a three-way valve 22, as illustrated, or two separate valves, as desired. Refrigeration system 10 conditions the air in a served space, indicated generally at 23. If the refrigeration system is a transport refrigeration system, for example, the served space may be the cargo space of a truck, trailer, container, and the like, with the refrigeration system 10 maintaining a desired temperature set point of the cargo space via cooling and heating cycles, both of which may utilize hot gas discharged from the discharge port D of refrigerant compressor 14. A defrost cycle also uses hot refrigerant gas, with the defrost cycle being similar to a heating cycle except heat generated by the hot refrigerant gas is used for defrosting purposes instead of for heating cargo space 23.

The first refrigerant path 18, indicated by arrows in FIG. 1, includes the discharge port D of compressor 14, a hot gas line 24, the three-way valve 22, a hot gas line 24' a condenser 26, a check valve 28, a liquid subcooling control valve 30, a liquid-gas separator or boiler 32, which will be hereinafter be referred to as flash tank 32, a solenoid valve 34, a heat exchanger 36, a suction superheat expansion valve 38, an evaporator 40, and a main suction line 42 which returns gaseous refrigerant from evaporator 40 to the suction port S of compressor 14. Check valve 28 and liquid subcooling control valve 30 are disposed in a liquid line 44 which interconnects the output side of condenser 26 to the input side of flash tank 32. Solenoid valve 34, heat exchanger 36, and suction superheat expansion valve 38 are connected in a liquid line 46 which extends from the output side of flash tank 32 to the input side of evaporator 40. The portion of liquid line 46 between the output side of superheat expansion valve 38 and the input side of evaporator 40 includes both saturated gas and liquid refrigerant.

Liquid line 44 preferably enters flash tank 32 at or near the top of tank 32, i.e., above a liquid line 45 in tank 32, to prevent the bubbling which would occur if the liquid line 44 entered tank 32 below liquid line 45. Reducing bubbling in tank 32 reduces the amount of refrigerant in gas form which enters liquid line 46.

The second refrigerant path 20, indicated by arrows in FIG. 2, includes the discharge port D of compressor 14, the hot gas line 24, the three-way valve 22, a hot gas line 24'', a heating condenser 48, which, for example, may be a separate set of tubes in the evaporator tube bundle, and an auxiliary liquid line 50 which taps the main liquid line 44 with a tee 52. Auxiliary liquid line 50 includes a check valve 54. Tee 52 is located between check valve 28 and the input side of liquid subcooling valve 30.

The liquid subcooling valve 30, which may be similar in construction to a conventional thermal expansion valve, includes a temperature control bulb 56, and a by-pass orifice 58. Control bulb 56 is disposed in heat exchange relation with the portion of liquid line 44 which is connected to the input side of subcooling valve 30. Liquid subcooling valve 30 functions to control the flow of liquid refrigerant into flash tank 32, opening and closing to maintain a desired subcooling in the liquid refrigerant. By-pass orifice 58, which may be either internal to valve 30, or external, as desired, provides an initial flow of refrigerant through valve 30 which enables valve 30 to start operating after the start-up transient.

Flash tank 32 separates liquid refrigerant from saturated gaseous refrigerant, via gravity, and its use eliminates the need for a separate receiver tank. As hereinbefore stated, flash tank 32 has a liquid level 45 which separates liquid refrigerant 60 from gaseous refrigerant, with flash tank 32 including a gas space 63 above liquid level 45. A J-tube 62 is preferably provided in flash tank 32, with the J-tube having a first end 64 disposed in the gas space 63, a second end 66 connected to the intermediate port IP of compressor 14 via an auxiliary suction line 68, and a bight 70 disposed in liquid 60. Bight 70 includes a small opening 72 for returning compressor lubricating oil to the compressor 14, which oil becomes entrained in the refrigerant during the operation of compressor 14.

Flash tank 32 includes means 74 for selectively heating and evaporating liquid refrigerant 60 located in flash tank 32 during heating and defrost cycles. Heating means 74 includes a heat source 76, a solenoid valve 78, and a heating jacket 79 disposed in heat transfer relation with flash tank 32. As indicated, the heat source 76 may include hot liquid 81 which cools the prime mover 16, when prime mover 16 is an internal combustion engine, with valve 78, when open, allowing hot engine coolant to circulate through heating jacket 79, in heat transfer relation with flash tank 32. Heat source 76 may be a source of electrical potential, such as an electrical generator, and heating jacket 79 may be electrically energized, when the prime mover 16 only includes an electric motor; or, heating jacket 79 may include means for electrically heating it, in addition to providing a path for hot engine coolant, when prime mover 16 includes an electric stand-by motor in addition to an internal combustion engine.

The suction superheat expansion valve 38, which may be a conventional refrigeration expansion valve, includes a temperature control bulb 80 disposed in heat exchange relation with the main suction line 42. The heat exchanger 36, through which the input and output lines to and from expansion valve 38 are directed, is optional. Heat exchanger 36 provides some sub-cooling in both directions through heat exchanger 36, with the subcooling provided for the refrigerant which flows through the initial flow path insuring that there are no gas bubbles in the liquid refrigerant as it enters the suction superheat expansion valve 38.

In a preferred embodiment of the invention, a small orifice 82 interconnects hot gas line 24'' and the main suction line 42, which, as will be hereinafter explained, improves the heating and defrost cycles.

For purposes of the following description of the operation of refrigeration system 10, it will be assumed that three-way valve 22, is normally in a position which directs hot refrigerant gas to the first refrigerant path 18, and that solenoid valves 34 and 78 are normally closed. Electrical control 84, associated with refrigeration system 10, energizes solenoid valve 34 during a cooling cycle, as indicated in FIG. 1. Control 84 energizes three-way valve 22, to select refrigerant path 20, and it energizes solenoid valve 78, during heating and defrost cycles, as indicated in FIG. 2.

Referring now to FIG. 1, which indicates a cooling cycle refrigerant flow path 18 with arrows, hot refrigerant gas from compressor 14 is directed to condenser 26 via three-way valve 22. The hot refrigerant gas is condensed and subcooled in condenser 26, and the subcooled liquid flows to the liquid subcooling valve 30 via the check valve 28. The liquid subcooling control valve 30 controls the rate of flow of liquid refrigerant into flash tank 32, opening when the sensed subcooling is too high, and closing when the sensed subcooling is too low, to maintain a desired degree of subcooling in the liquid refrigerant. Check valve 54 prevents liquid flow to the lower pressure heating condenser 48.

Solenoid valve 78 is closed and solenoid valve 34 is open during a cooling cycle. Liquid line 46 is disposed to receive liquid refrigerant 60, from a point below the liquid level 45 of flash tank 32, to insure that only liquid refrigerant 60 is drawn from flash tank 32. As hereinbefore stated, the optional heat exchanger 36 is desired in a preferred embodiment of the invention, in order to insure that there are no gas bubbles in the liquid refrigerant when the liquid refrigerant enters the suction superheat valve 38. Suction superheat valve 38, which is controlled by the temperature of the suction line 42 adjacent to the output of evaporator 40, controls the amount of liquid refrigerant allowed to flow from flash tank 32 into evaporator 40. The heat exchanger 36 provides some subcooling to the liquid portion of the mixed saturated gas and liquid refrigerant which flows from expansion valve 38 into evaporator 40. The resulting revised quality mixture of saturated gas and liquid which exits heat exchanger 36 is evaporated and super heated by evaporator 40 due to heat transfer from air returning from the controlled cargo space 23. The superheated gas returns to the suction port S of compressor 14 via the main suction line 42.

During a cooling cycle, the intermediate port IP of compressor 14 pulls saturated gaseous refrigerant from gas space 63 in flash tank 32, via J-tube 62 and the auxiliary suction line 68. The mass flow rate of refrigerant entering the intermediate pressure point IP is equal to about one-half of the mass refrigerant flow returning to the suction port S via the main suction line 42. The primary function of the mass flow to the intermediate port IP is to reduce the pressure in the flash tank 32 so that liquid refrigerant with the maximum subcooling can be provided to the suction superheat expansion valve 38. A secondary benefit is that this mass flow to the intermediate port IP cools the compressor 14, resulting in lower discharge temperatures than a compressor operating without an intermediate port IP. As hereinbefore stated, the flash tank 32 provides more subcooling than an economizer heat exchanger, since it does not have the heat transfer loss.

During a cooling cycle, refrigerant trapped in the closed heating condenser 48 and associated refrigerant circuits, is allowed to flow into the cooling cycle refrigerant circuit via the optional orifice 82, which is utilized in a preferred embodiment of the invention. Thus, orifice 82 reduces the amount of refrigerant charge which would ordinarily be required to operate transport refrigeration system 10 during a cooling cycle.

During heating and evaporator defrost cycles, the hot refrigerant gas flows from the discharge port D of compressor 14 to the heating condenser 48 via three-way valve 22, which is controlled by electrical control 84 to direct the gas to refrigerant path 20 and hot gas line 24''. The hot gas is condensed and subcooled in heating condenser 48 by heat transfer to the cargo space 23 during a heating cycle, or to frost and ice on the evaporator coil 40 during a defrost cycle.

The subcooled liquid refrigerant flows through the auxiliary liquid line 50 to tee 52 in liquid line 44, via check valve 54. Check valve 28 now functions to prevent liquid refrigerant from flowing into the lower pressure condenser 26. The liquid subcooling valve 30 operates the same as described during a cooling cycle, controlling flow of the expanded saturated liquid/gas mixture of refrigerant into flash tank 32. Solenoid valve 34 is closed during a heating/defrost cycle to prevent flow of liquid refrigerant to the lower pressure evaporator 40. Solenoid valve 78 is open during a heating/defrost cycle to allow heat source 76 to heat flash tank 32, e.g., to allow hot engine coolant to circulate around the outside surface of the flash tank 32. The liquid refrigerant 60 in flash tank 32 is evaporated by heat transferred from the heating jacket 79, with the evaporated saturated gas returning to the intermediate port IP of compressor 14. The evaporator 40 is allowed to pump down into a vacuum during a heating/defrost cycle. An optional internal (to the compressor), or external, solenoid valve may be used to connect the main and auxiliary suction lines 42 and 68, respectively, during a heating/defrost cycle, so that the compressor seal may remain pressurized. The optional bleed orifice 82 provides no useful function during a heating/defrost cycle, but if sized correctly it will not significantly affect the performance of a heat/defrost cycle.

In summary, the invention teaches methods and apparatus which improves stationary refrigeration systems which utilize an economizer cycle, and the invention makes the use of a flash tank 32 practical in a mobile or transport refrigeration system. The invention eliminates the need for a float valve in a refrigeration system which utilizes an economizer cycle by controlling the liquid level in the flash tank 32 via a liquid subcooling valve 30, which controls the entering flow of refrigerant from condenser 26, and via a suction superheat valve 38, which controls the exiting flow of refrigerant 60 to the evaporator 40. In a preferred embodiment of the invention, a bleed orifice 82 is utilized to enhance a cooling cycle by permitting refrigerant trapped in the heating condenser 48 to enter a cooling cycle.

I claim:

1. A method of using a flash tank in a refrigeration system which has an economizer cycle, including a refrigerant circuit having a refrigerant compressor which includes a suction port, an intermediate pressure port, and a discharge port, a condenser, an evaporator, a liquid line between the condenser and evaporator, a main suction line between the evaporator and the suction port, an auxiliary suction line between the flash tank and the intermediate pressure port, and a hot gas line between the discharge port and condenser, comprising the steps of:

providing a flash tank in the liquid line having a liquid input point and a liquid output point, providing refrigerant storage space in the flash tank between the liquid input point and the liquid output point, providing a cooling cycle by directing refrigerant from the compressor and condenser to the liquid input point of the flash tank, and from the liquid output point of the flash tank to the evaporator, controlling the flow of refrigerant which enters the liquid input point of the flash tank from the condenser with a liquid sub-cooling valve, which opens and closes to maintain a predetermined degree of sub-cooling in the refrigerant, and controlling the flow of refrigerant which flows from the liquid output point of the flash tank to the evaporator with a thermostatic expansion valve which has a temperature control bulb disposed in heat exchange relation with the main suction line, whereby the need for a float valve in the flash tank to control refrigerant flow is eliminated.

2. The method of claim 1 including the step of sub-cooling the refrigerant entering the thermostatic expansion valve.

3. The method of claim 1 including the step of providing a by-pass orifice around the liquid sub-cooling valve to aid start-up.

4. A method of using a flash tank in a refrigeration system which has an economizer cycle, including a refrigerant circuit having a refrigerant compressor which includes a suction port, an intermediate pressure port, and a discharge port, a condenser, an evaporator, a liquid line between the condenser and evaporator, a main suction line between the evaporator and the suction port, an auxiliary suction line between the flash tank and the intermediate pressure port, and a hot gas line between the discharge port and condenser, comprising the steps of:

providing a flash tank, providing a cooling cycle by directing refrigerant from the compressor and condenser to the evaporator via the flash tank, controlling the flow of refrigerant which enters the flash tank from the condenser with a liquid sub-cooling valve, which opens and closes to maintain a predetermined degree of sub-cooling in the refrigerant, controlling the flow of refrigerant which flows from the flash tank to the evaporator with a thermostatic expansion valve which has a temperature control bulb disposed in heat exchange relation with the main suction line, providing a heating condenser in heat exchange relation with the evaporator, providing a hot gas heating cycle for the refrigeration system by connecting the hot gas line to the heating condenser instead of the condenser, and providing an orifice which interconnects the heating condenser and the main suction line, to permit refrigerant trapped in the heating condenser after a heating cycle to enter a cooling cycle, whereby the need for a float valve in the flash tank to control refrigerant flow is eliminated.

5. The method of claim 4 including the step of blocking refrigerant flow from the flash tank to the evaporator during a heating cycle.

6. The method of claim 4 including the step of returning refrigerant from the heating condenser, during a heating cycle, to the liquid line between the condenser and liquid sub-cooling valve.

7. The method of claim 4 including the step of heating the flash tank during a heating cycle.

8. The method of claim 4 including the steps of:

driving the compressor with a liquid cooled internal combustion engine, and using liquid coolant from the internal combustion engine to heat the flash tank during a heating cycle.

9. A refrigeration system for cooling a served space which has an economizer cycle, including a refrigerant circuit having a compressor which includes a suction port, an intermediate pressure port, and a discharge port, a condenser, an evaporator, a liquid line between the condenser and evaporator, a main suction line between the evaporator and the suction port, and a hot gas line between the discharge port and condenser, comprising:

a flash tank in the liquid line, said flash tank having liquid input and liquid output points, with the flash tank defining a storage space for refrigerant between said liquid input point and said liquid output point, an auxiliary suction line between the flash tank and the intermediate pressure port, a liquid sub-cooling valve disposed between the condenser and the liquid input point of said flash tank, said liquid sub-cooling valve controlling the flow of refrigerant which enters the liquid input point of said flash tank from the condenser by opening and closing to maintain a predetermined degree of sub-cooling in the refrigerant, and a thermostatic expansion valve disposed between the liquid output point of said flash tank and the evaporator, said thermostatic expansion valve having a temperature control bulb disposed in heat exchange relation with the main suction line, said thermostatic expansion valve controlling the flow of refrigerant from the liquid output point of said flash tank to the evaporator, whereby the need for a float valve in the flash tank to control refrigerant flow is eliminated.

10. The refrigeration system of claim 9 including means for sub-cooling the refrigerant entering the thermostatic expansion valve.

11. The refrigeration system of claim 10 wherein the sub-cooling means is a heat exchanger having a first flow path which interconnects the flash tank and the thermostatic expansion valve, and a second flow path which interconnects the thermostatic expansion valve and the evaporator, with said first and second flow paths being in heat exchange relation.

12. The refrigeration system of claim 9 including a by-pass orifice disposed to by-pass the liquid sub-cooling valve, to aid start-up.

13. The refrigeration system of claim 9 including:

means for providing a hot gas heating cycle to heat the served space or defrost the evaporator coil, said means for providing a hot gas heating cycle including a heating condenser and valve means, said heating condenser being disposed in heat exchange relation with the evaporator, said valve means being disposed in the hot gas line, said valve means connecting the compressor to the condenser during a cooling cycle, said valve means connecting the compressor to the heating condenser during a hot gas heating cycle.

14. The refrigeration system of claim 13 including means disposed to block refrigerant flow from the flash tank to the evaporator during a heating cycle.

15. The refrigeration system of claim 13 including conduit means connected to return refrigerant from the heating condenser to the liquid line, at a point located between the condenser and the liquid sub-cooling valve, during a heating cycle.

16. The refrigeration system of claim 13 including means heating the flash tank during a heating cycle.

17. A refrigeration system for cooling a served space which has an economizer cycle, including a refrigerant circuit having a compressor which includes a suction port, an intermediate pressure port, and a discharge port, a condenser, an evaporator, a liquid line between the condenser and evaporator, a main suction line between the evaporator and the suction port, and a hot gas line between the discharge port and condenser, comprising:

a flash tank in the liquid line, an auxiliary suction line between the flash tank and the intermediate pressure port of the compressor, a liquid sub-cooling valve disposed between the condenser and the flash tank, said liquid sub-cooling valve controlling the flow of refrigerant which enters the flash tank from the condenser by opening and closing to maintain a predetermined degree of sub-cooling in the refrigerant, a thermostatic expansion valve disposed between the flash tank and the evaporator, said thermostatic expansion valve having a temperature control bulb disposed in heat exchange relation with the main suction line, said thermostatic expansion valve controlling the flow of refrigerant from the flash tank to the evaporator, means for providing a hot gas heating cycle to heat the served space or defrost the evaporator coil, said means for providing a hot gas heating cycle including a heating condenser and valve means, said heating condenser being disposed in heat exchange relation with the evaporator, said valve means being disposed in the hot gas line, said valve means connecting the compressor to the condenser during a cooling cycle, said valve means connecting the compressor to the heating condenser during a hot gas heating cycle, and an orifice disposed to interconnect the heating condenser and the main suction line, to permit refrigerant trapped in the heating condenser during a heating cycle, to enter a cooling cycle, whereby the need for a float valve in the flash tank to control refrigerant flow is eliminated.

18. The refrigeration system of claim 16 including a liquid cooled internal combustion engine disposed to drive the refrigerant compressor, with the means for heating the flash tank during a heating cycle including means for directing liquid coolant from the internal combustion engine into heat exchange relation with the flash tank.

* * * * *